US006092666A

United States Patent [19]

Clark et al.

[11] Patent Number: 6,092,666

[45] Date of Patent: Jul. 25, 2000

[54] REDUCTION OF PH MODIFYING AGENT IN THE FLOTATION OF COPPER MINERALS

[75] Inventors: David William Clark, Gladesville; Andrew James Haigh Newell, Chatswood, both of Australia

[73] Assignee: BOC Gases Australia Limited, New South Wales, Australia

[21] Appl. No.: 09/114,268

[22] Filed: Jul. 13, 1998

[30] Foreign Application Priority Data

Jul. 14, 1997 [AU] Australia ..... P07884

[51] Int. Cl.[7] ..... B03D 1/02; B03B 1/04; B03B 1/00

[52] U.S. Cl. ..... 209/164; 209/166; 209/167

[58] Field of Search ..... 209/164, 166, 209/167

[56] References Cited

U.S. PATENT DOCUMENTS

| | | |
|---|---|---|
| 1,505,323 | 8/1924 | Eberenz . |
| 2,154,092 | 4/1939 | Hunt . |
| 4,735,783 | 4/1988 | Bulatovic . |

FOREIGN PATENT DOCUMENTS

| | | |
|---|---|---|
| 499430 | 12/1976 | Australia . |
| 593065 | 9/1987 | Australia . |
| 39027/95 | 5/1996 | Australia . |
| 2163688 | 5/1996 | Canada . |
| 37-15310 | 9/1962 | Japan . |
| WO 96/01150 | 1/1996 | WIPO . |

OTHER PUBLICATIONS

Xu et al., "Sphalerite Reverse Flotation Using Nitrogen," Proc. Electrochem Soc., vol. 92–17, Proc. Int. Symp. Electrochem. Miner. Met. Process. III, 3rd, pp. 170–190 (1992).

Kongolo et al., "Improving the efficiency of sulphidization of oxidized copper ores by column and inert gas flotation," Proceedings of COPPER 95—COBRE 95 International Conference, vol. II, The Metallurgical Society of CIM, pp. 183–196, 1995.

*Primary Examiner*—Thomas M. Lithgow

[57] ABSTRACT

A method is provided for reducing the consumption of alkaline pH modifier in a mineral separation circuit which employs sulfoxy radical-containing reagents. The method comprises the addition of a non-oxidizing gas to the mineral separation circuit prior to and/or simultaneously with the addition of the sulfoxy radical-containing reagent. The non-oxidizing gas is added in a quantity sufficient to achieve a chemical environment conducive to the flotation separation of minerals. The inventive process is suitable for a wide range of valuable minerals including sulfidic copper minerals or mixtures of sulfidic and non-sulfidic copper minerals, sulfidic iron minerals (particularly pyrite) and non-sulfidic gangue material. It is particularly suitable for sedimentary copper deposits, copper skarns, porphyry copper/molybdenum/gold deposits and super gene enrichments.

12 Claims, 2 Drawing Sheets

REDUCTION OF PH MODIFYING AGENT IN THE FLOTATION OF COPPER MINERALS

The present invention relates to the physical separation of minerals and in particular the separation of minerals with different mineralogical character.

BACKGROUND OF THE INVENTION

In the flotation separation of various minerals, pH plays an important role. Indeed, where possible flotation is carried out in an alkaline medium as most collectors, including xanthates, are stable under alkaline conditions and the corrosion of cells, pipework and the like is minimized. Generally, alkalinity is controlled by the addition of lime, sodium carbonate (soda ash) and, to a lesser extent, sodium hydroxide or ammonia. Acidic compounds such as sulfuric or sulfurous acid are used where a decrease in pH is required.

Generally, lime is used to regulate pulp alkalinity since it is cheap and readily available. It is normally used in the form of milk of lime, which is an aqueous suspension of calcium hydroxide particles. The lime, or alternatively soda ash, is often added to the slurry prior to flotation to precipitate heavy metal ions from solution.

These pH-altering chemicals are often used in significant amounts. Although they are cheaper than collectors and frothers, due to the quantity utilized, the overall cost is generally higher with pH regulators per ton of ore treated than with any other processing chemical. Indeed, the cost of lime for example in many sulfide mineral flotation operations is roughly double that of the collector used.

In conjunction with an appropriate xanthate collector, sufficient alkali will depress almost any sulfide mineral and for any concentration of a particular collector, there is a pH value below which any given mineral will float and above which it will not float. This, of course, allows an operator to selectively float various sulfide minerals from an ore slurry. The "critical pH" value of any ore depends on the nature of the mineral, the particular collector, its concentration and the temperature.

Additionally, lime by itself, or in conjunction with a sulfoxy reagent, acts to depress certain minerals. For example in complex copper/lead/zinc ores, lime with or without sulfoxy reagents acts to depress sphalerite, pyrite and pyrrhotite.

A typical flow chart for a conventional flotation process using lime for pH adjustment is shown in FIG. 1. The slurry is initially mixed with lime in the milling circuit 10. A further pH adjustment 12 may be included where pH is increased to around 9–11, preferably 10.5, by the further addition of lime. A collector and frother may then be added in a reagent conditioning stage 14 followed by the flotation stage(s) 16.

There are, however, difficulties associated with the conventional use of lime and other alkaline agents to alter the pH of the slurry entering a conventional flotation circuit. First, the quantity of lime required in the preparation of the slurry prior to flotation is a significant factor in the cost of preparation. Further, the calcium ions, in the lime, can deposit onto valuable minerals reducing their floatability.

The process provided in accordance with the present invention at least partially overcomes these and other difficulties of the prior art or at least provide a commercial alternative to the prior art.

SUMMARY OF THE INVENTION

The present invention provides a method of reducing the consumption of alkaline pH modifiers in a mineral separation circuit employing sulfoxy radical-containing reagents wherein prior to or simultaneously with the introduction of the sulfoxy radical-containing reagent non-oxidizing gas is added in a quantity sufficient to achieve a chemical environment conducive to flotation separation of the minerals.

DETAILED DESCRIPTION OF THE PREFERRED EMBODIMENTS

Figure 1:
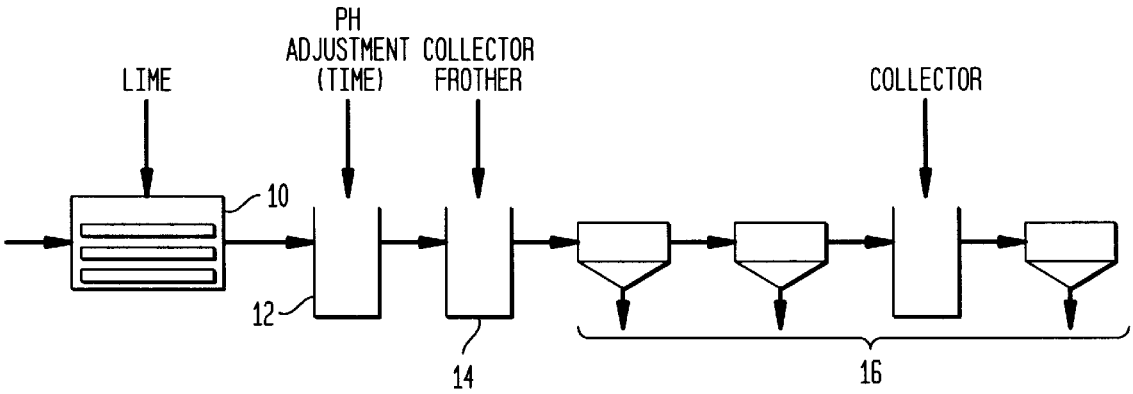
FIG. 1 (PRIOR ART)
FIG. 1 is a flow sheet of a conventional flotation process using lime for the pH adjustment.

In accordance with the present invention, it has been found that conditioning a slurry or flotation concentrate with an inert/non-oxidizing gas and a sulfoxy compound provides a chemical environment conducive to the flotation separation of the valuable minerals from the non-valuable minerals. The process of the invention, therefore, substantially eliminates, or at least materially reduces, the addition of alkaline pH modifying agents including lime and derivative compounds such as cement, clinker, quicklime, hydrated lime, limestone and the like as well as soda ash, caustic soda and ther similar materials.

The present process is particularly suitable for slurries or flotation concentrates having a mixture of valuable minerals including sulfidic copper minerals, or sulfidic and non-sulfidic copper minerals, non-valuable sulfidic iron minerals, particularly pyrite, and non-sulfidic "gangue" materials. The present inventive process is suitable for a wide variety of ores including but not limited to sedimentary copper deposits, copper skarns, porphyry copper/molybdenum/gold deposits and supergene enrichments.

Suitable sulfoxy radical-containing compounds utilized for this purpose include sulfite and bisulfite compounds, alkali metal, ammonium or alkaline earth metal salts thereof, for example, alkali metal salts containing sulfoxy radicals. Examples of specific agents include sodium sulfite, sodium hydrogen sulphite, sodium metabisulfite, sodium bisulfite, sulfur dioxide gas or solution and the like.

The non-oxidizing gas is conveniently to be selected from the group consisting of inert gases, carbon dioxide, methane, ethane, propane and sulfur dioxide, the latter possessing an additional advantage in that it may itself be utilized as a sulfoxy radical-containing reagent. Of the inert gases, nitrogen is most preferred for cost reasons, but other art-recognized inert gases, such as argon, can be utilized as well.

The duration and intensity of the conditioning step carried out in accordance with the present invention will depend upon a number of factors including the type of ore undergoing flotation, the amount and type of sulfoxy radical-containing reagent added in conjunction with the non-oxidizing gas conditioning and the dissolved oxygen content of the slurry.

In the case of some ore types, it may be important to control the pH to a fixed level prior to carrying out the inventive process. Accordingly, it should be understood that the use of alkaline pH modifying agents is contemplated in such circumstances in conjunction with the present inventive process, however, the amounts of such agents required will be markedly reduced in comparison to conventional processes.

Turning to the drawings, as discussed above, FIG. 1 depicts a conventional separation circuit showing the initial addition of lime 10 to adjust the pH of the slurry entering the separation. In FIG. 2 which illustrates a first embodiment of the process of the invention, the ore slurry to be treated is first passed through a milling circuit 100 to reduce the particle size to a level suitable for subsequent flotation. The milled slurry is then conditioned for between 1 and 10 minutes, preferably 2 to 5 minutes, with non-oxidizing gas, e.g. nitrogen, in conditioning stage 120. In a further reagent stage 140 a sulfoxy-radical containing reagent, for example sodium metabisulfite (SMBS), is added and the non-oxidizing gas conditioning continued for between 1 and 10 minutes, preferably 2 to 5 minutes. The flow of non-oxidizing gas is then stopped.

Appropriate collectors and frothers for effecting flotation of the slurry may then be added in reagent conditioning stage 160 and the slurry conditioned for one minute.

The conditioned slurry is then floated in flotation stage(s) 180 with air to effect recovery of the valuable minerals from the non-valuable minerals. It is also possible that prior to addition of the collector and flotation at stage 160, but after the non-oxidizing gas/sulfoxy-radical containing reagent conditioning at stages 120 and 140, the slurry may require oxidative gas conditioning in stage 150 to a particular dissolved oxygen concentration, e.g. DO≈2 ppm or electrochemical potential which is suitable for flotation of the particular sulfide mineral. Suitable oxidative gases include, air, oxygen, oxygen-enriched air, and the like. It is understood, however, that the addition of oxidative gas is only employed when sensors in the slurry determine that it is necessary. Suitable dissolved oxygen and electrochemical potential sensors are known from use in chemical processes and thus further description is not provided herein.

For reasons that are not as yet entirely understood, the present inventive conditioning step reduces and in some cases eliminates the need for lime addition. Even in the case where the use of lime is not completely avoided, there is a significant reduction in the lime required to effect flotation separation of the valuable minerals. As mentioned above, this lower lime addition reduces the quantity of calcium ions in the slurry which may deposit onto the valuable minerals thereby reducing their floatability.

Figure 2:
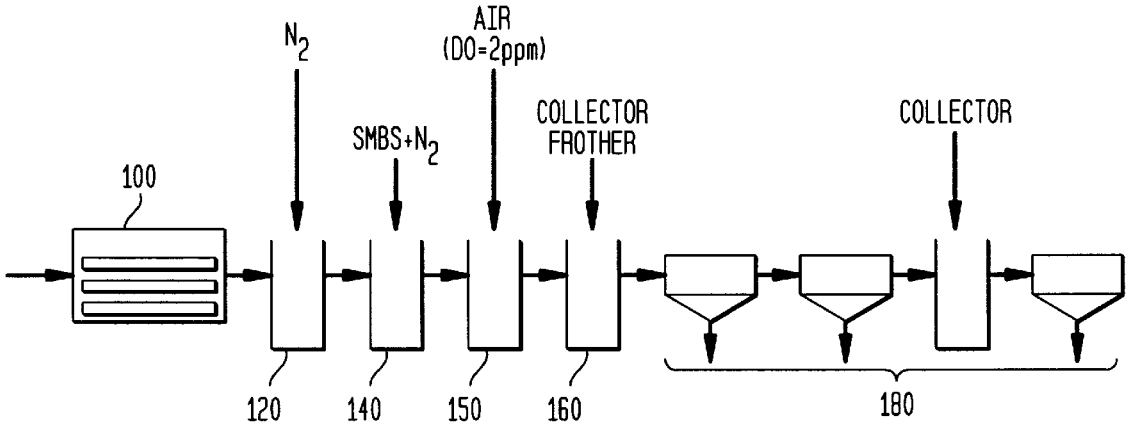
FIG. 2 is a flow sheet of a flotation circuit according to a first embodiment of the present invention.
Figure 3:
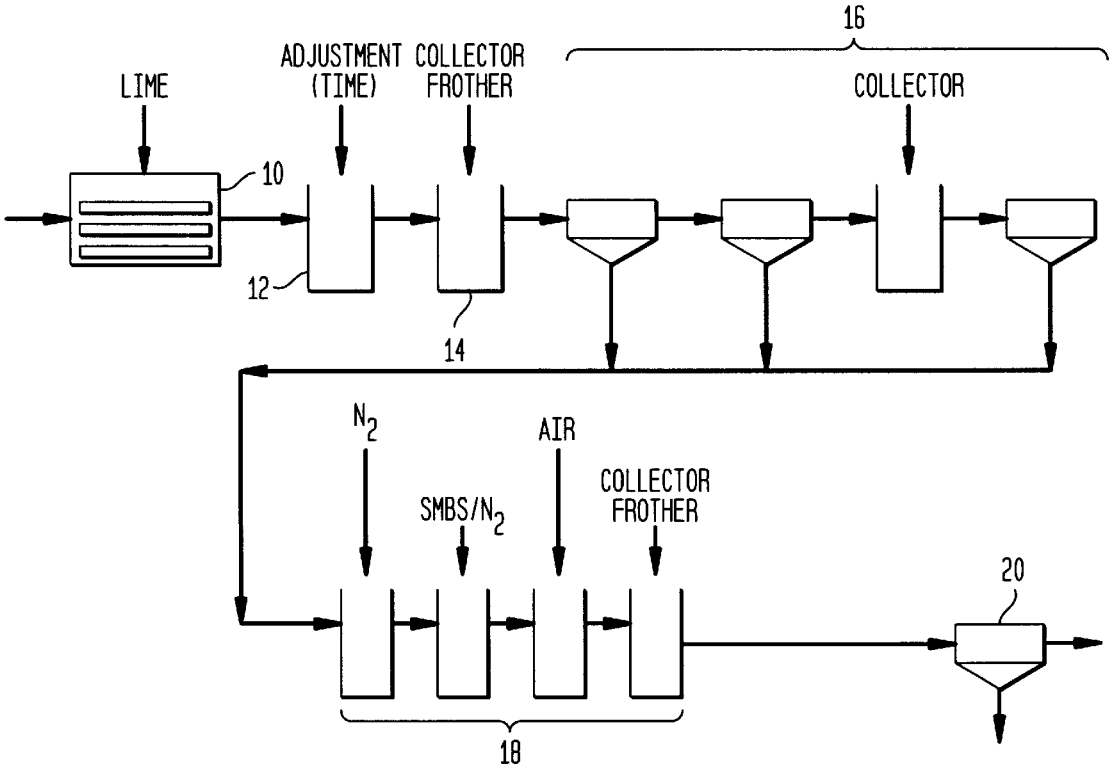
FIGS. 3 and 4 are flow sheets of flotation circuits according to second and third embodiments of the present invention.

FIG. 2 shows the present inventive process when used in the rougher/scavenger flotation stages, however, it should also be understood that the present invention can be used in the cleaning stages of a flotation circuit as shown more clearly in FIG. 3. In this embodiment, stages 10–16 are of conventional design. Cleaning stages 18 and 20, however, are in accordance with the present inventive process in which a non-oxidizing gas, such as nitrogen, is added prior to or simultaneously with the addition of a sulfoxy radical containing reagent.

Figure 4:
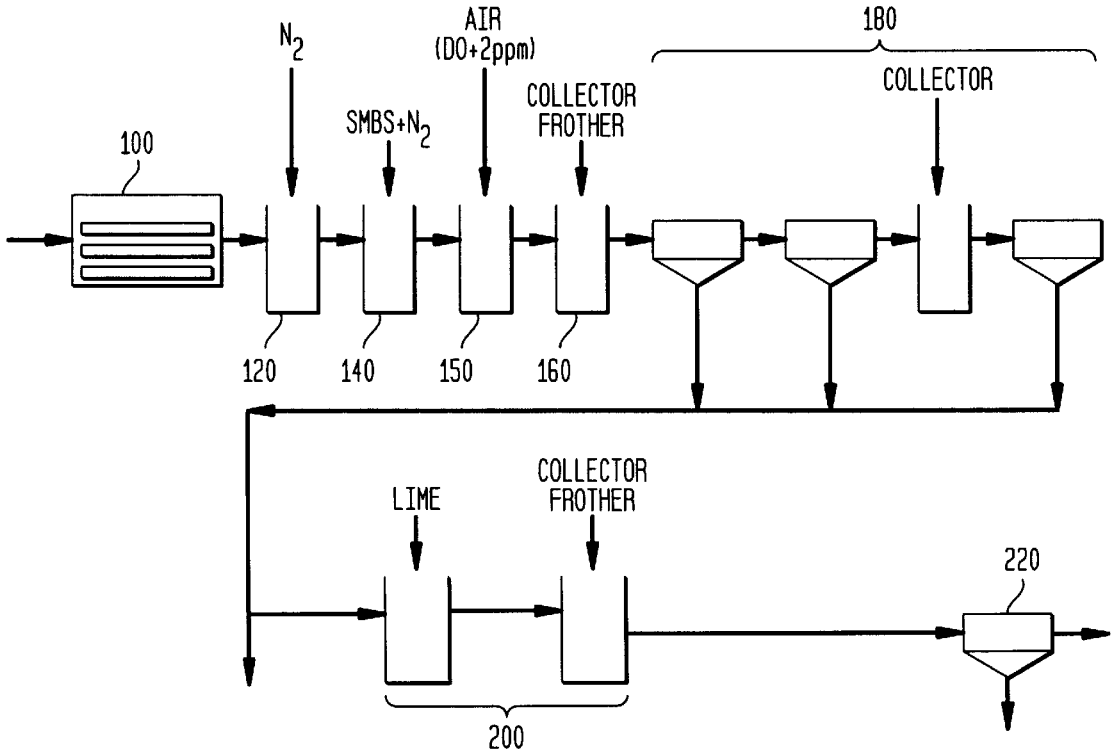

In still a further embodiment, as shown in FIG. 4, the use of the present inventive process in the rougher/scavenger flotation stages offers the opportunity to cost effectively apply different chemistry to the subsequent cleaning stages.

As shown in FIG. 4, the rougher/scavenger flotation stages 100–180 are in accordance with the present inventive process. Prior to cleaning stage 220, a conventional pH conditioning stage 200 may be provided in which lime or a similar pH modifying agent is added to the slurry with beneficial results. The amount of such agent, however, is reduced in comparison to that used in conventional processes.

Lastly, a surprising result achieved by the present invention is the increase in molybdenum flotation for copper/molybdenum ore types. The applicants have found that conducting flotation at a lower pH, i.e. with less lime addition, is more conducive to molybdenum flotation. Accordingly, if it is desired to float molybdenum from a complex ore it is no longer necessary to add acidic compounds to lower the pH to a suitable level for molybdenum flotation.

The following examples serve to further illustrate the present invention.

EXAMPLE 1

Standard Conditions—pH 10.4

A test was conducted in a conventional separation circuit similar to that illustrated in FIG. 1. A 1 kg charge of crushed copper porphyry ore containing copper minerals chalcocite and chalcopyrite assaying 0.6 percent copper was slurried in water to obtain a pulp density 55 wt % solids and milled in a stainless steel rod mill employing stainless steel rods to achieve P80 of approximately 300 microns in the presence of 1 gram of lime. The milled slurry was then transferred to a 2.5 liter Denver flotation cell and diluted to approximately 35 percent solids with water. The pH of the slurry was measured and no addition lime was required. The appropriate quantities of collector and frother were then added and the slurry was conditioned for 1 minute. At the completion of conditioning flotation with air was commenced and three concentrates were produced from 3, 6 and 9 minutes respectively of flotation. Additional collector was added after the first and second concentrates had been produced. The combined concentrates and flotation tailings were filtered, dried, weighed and the copper contents determined by assay.

EXAMPLE 2 pH9.2

A test was conducted in a circuit similar to that shown in FIG. 2 and using the same ore and equipment as that described in Example 1 and the same total collector and frother additions.

After milling without lime addition, the slurry was transferred to the flotation cell. The pH was measured and sufficient lime added to achieve a pH of 9.2 (approximately 750 gpt). Nitrogen gas was then added at 4 lpm until the slurry dissolved oxygen content was approximately 1 ppm. Then 100 gpt of sodium metabisulphite (SMBS) was added as a solution and the slurry was conditioned for 5 minutes while maintaining nitrogen addition at 4 lpm. The appropriate quantities of collector and frother were then added and the slurry was conditioned for 1 minute. At the completion of conditioning flotation with air was commenced and three concentrates were produced from 3, 6 and 9 minutes respectively of flotation. Additional collector was added after the first and second concentrates had been produced. The combined concentrates and flotation tailings were filtered, dried, weighed, and the copper contents determined by assay.

EXAMPLE 3 pH 7.5

A test was conducted in a circuit similar to that shown in FIG. 2 and using the same ore and equipment as that described in Example 1 and the same total collector and frother additions.

After milling without lime addition, the slurry was transferred to the flotation cell. The pH was measured and sufficient lime added to achieve a pH of 7.5 (approximately 500 gpt). Nitrogen gas was then added at 4 lpm until the slurry dissolved oxygen content was approximately 1 ppm. Then 50 gpt of SMBS was added as a solution and the slurry was conditioned for 5 minutes while maintaining nitrogen addition at 4 lpm. The appropriate quantities of collector and frother were then added and the slurry was conditioned for 1 minute. At the completion of conditioning, flotation with air was commenced and three concentrates were produced from 3, 6 and 9 minutes respectively of flotation. Additional collector was added after the first and second concentrates had been produced. The combined concentrates and flotation tailings were filtered, dried, weighed, and the copper contents determined by assay. The results of the preceding evaluations are summarized in the following table.

| TEST | SMBS ADDITION gpt | LIME ADDITION gpt | FLOTATION pH | Cu ASSAY | Cu RECOVERY % |
|---|---|---|---|---|---|
| 1 | 0 | 1000 | 10.4 | 7.41 | 68.6 |
| 2 | 100 | 750 | 9.2 | 6.02 | 72.8 |
| 3 | 50 | 500 | 7.5 | 7.03 | 73.7 |

The results clearly show that lime addition can be reduced substantially while flotation metallurgy as shown by copper recovery has increased.

EXAMPLE 4 pH 5.0

In this example, a separation was conducted without the addition of lime in a circuit similar to that shown in FIG. 2, using the same ore and equipment as that described in Example 1 as well as the same total collector and frother additions.

After milling without lime addition, the slurry was transferred to the flotation cell. The pH of the slurry was measured. Nitrogen gas was then added at 4 lpm until the slurry dissolved oxygen content was approximately 1 ppm. Then 200 gpt of SMBS was added as a solution and the slurry was conditioned for 5 minutes while maintaining nitrogen addition at 4 lpm. The appropriate quantities of collector and frother were then added and the slurry was conditioned for 1 minute. At the completion of conditioning flotation with air was commenced and three concentrates were produced from 3, 6 and 9 minutes respectively of flotation. Additional collector was added after the first and second concentrates had been produced. The combined concentrates and flotation tailings were filtered, dried, weighted, and the copper contents determined by assay.

The results of the test carried out in Example 4 as compared to the other tests are summarised as follows:

| TEST | SMBS ADDITION gpt | LIME ADDITION gpt | FLOTATION pH | Cu ASSAY | Cu RECOVERY % |
|---|---|---|---|---|---|
| 1 | 0 | 1000 | 10.4 | 7.41 | 68.6 |
| 2 | 100 | 750 | 9.2 | 6.02 | 72.8 |
| 3 | 50 | 500 | 7.5 | 7.03 | 73.7 |
| 4 | 200 | 0 | 5.0 | 7.76 | 59.0 |

While for the ore tested, the complete elimination of lime and flotation at pH 5.0 resulted in significantly poorer metallurgy, there it would appear that for some ores lime can be eliminated. This could depend on the pH of the slurry.

The present inventive process may be used with conventional apparatus which will be well-known to persons skilled in the art and it will be understood that the present inventive process may be embodied in forms other than that shown without departing from the spirit or scope of the invention.

We claim:

1. A method of reducing the amount of alkaline pH modifier to be added to a slurry of minerals to be separated to achieve a pH conducive to the flotation separation of the minerals in a mineral separation circuit which includes the addition to the slurrv of a sulfoxy radical-containing reagent comprising conditioning the slurry by introducing, prior to, simultaneously with, or both prior to and simultaneously with the introduction of the sulfoxy radical-containing reagent, a quantity of a non-oxidizing gas comprising one or more inert gases sufficient to achieve a chemical environment in the slurry conductive to the flotation separation of the minerals.

2. A method in accordance with claim 1, wherein said sulfoxy radical-containing reagents are selected from the group consisting of compounds containing metabisulfite, bisulfite and sulfite radicals, and alkali metal, alkaline earth metal and ammonium salts of such compounds, and mixtures thereof.

3. A method in accordance with claim 2, wherein a sulfoxy radical-containing reagent is selected from the group consisting of sodium sulfite, sodium metabisulfite, sodium bisulfite and mixtures thereof.

4. A method in accordance with claim 1, wherein after the conditioning of the slurry and the addition of the sulfoxy-radical-containing reagent and prior to flotation, the slurry undergoes an oxidative gas conditioning to provide a dissolved oxygen concentration or electrochemical potential which is suitable for flotation of the mineral.

5. A method in accordance with claim 1, wherein the inert gas is nitrogen.

6. A method in accordance with claim 1, wherein the slurry in conditioned with the non-oxidizing gas for between about 1 and 10 minutes.

7. A method in accordance with claim 1, wherein the slurry in conditioned with the non-oxidizing gas for between about 2 and 5 minutes.

8. A method in accordance with claim 1, wherein the slurry is conditioned with the non-oxidizing gas both prior to and simultaneously with the addition of the sulfoxy radical-containing reagent.

9. A method in accordance with claim 1, wherein the slurry contains a mixture of valuable minerals including sulfidic copper minerals, sulfidic and non-sulfidic copper minerals, non-valuable sulfidic iron minerals and non-sulfidic gangue material.

10. A method in accordance with claim 1, wherein the conditioning of the slurry and the addition of the sulfoxy-radical-containing reagent are carried out in the rougher/scavenger flotation stage of a mineral separation circuit.

11. A method in accordance with claim 1, wherein the conditioning of the slurry and the addition of the sulfoxy-radical-containing reagent are carried out in the cleaning stage of a mineral separation circuit.

12. A method in accordance with claim 11, wherein the pH of the slurry is determined prior to the cleaning stage and said alkaline pH modifier is added to achieve a pH suitable for flotation.

* * * * *